US008448975B2

(12) United States Patent
Kostantin

(10) Patent No.: US 8,448,975 B2
(45) Date of Patent: May 28, 2013

(54) STEP-IN TELEMARK SKI BINDING

(76) Inventor: Dan Kostantin, Courtenay (CA)

( * ) Notice: Subject to any disclaimer, the term of this patent is extended or adjusted under 35 U.S.C. 154(b) by 246 days.

(21) Appl. No.: 12/744,680

(22) PCT Filed: Dec. 22, 2008

(86) PCT No.: PCT/CA2008/002308

§ 371 (c)(1),
(2), (4) Date: May 25, 2010

(87) PCT Pub. No.: WO2009/079799

PCT Pub. Date: Jul. 2, 2009

(65) Prior Publication Data

US 2010/0253021 A1 Oct. 7, 2010

Related U.S. Application Data

(60) Provisional application No. 61/016,202, filed on Dec. 21, 2007.

(51) Int. Cl.
*A63C 9/08* (2006.01)

(52) U.S. Cl.
USPC ..... 280/619; 280/615

(58) Field of Classification Search
USPC ..... 280/611, 612, 614, 615, 619, 620, 280/621, 622, 634, 635; 36/117.2
See application file for complete search history.

(56) References Cited

U.S. PATENT DOCUMENTS

| | | | | |
|---|---|---|---|---|
| 3,942,811 | A * | 3/1976 | Salomon | 280/613 |
| 4,154,008 | A * | 5/1979 | Jacobs | 36/117.2 |
| 4,273,355 | A * | 6/1981 | Storandt | 280/614 |
| 4,441,732 | A * | 4/1984 | Napflin | 280/614 |
| 6,398,246 | B1 * | 6/2002 | Okajima | 280/263 |
| 7,246,812 | B1 * | 7/2007 | Ayliffe | 280/615 |
| 7,384,057 | B2 * | 6/2008 | Steffen et al. | 280/611 |
| 7,401,802 | B2 * | 7/2008 | Walker et al. | 280/614 |

FOREIGN PATENT DOCUMENTS

FR 2824747 * 11/2002

* cited by examiner

*Primary Examiner* — Frank Vanaman
(74) *Attorney, Agent, or Firm* — Gordon Thomson

(57) ABSTRACT

A step-in binding for reversibly securing a boot to sports equipment comprises a toe portion (a toe iron or toe box) that engages the toe of the boot and a cable having both ends connected to the front portion. The cable extends from the front portion around the heel of the boot. The cable includes a heel lever that engages both the heel of the boot and a heel block such that the boot heel remains free to be lifted vertically relative to the ski and binding. The heel of the boot is reversibly secured to the sports equipment by frictional forces between a camming surface of the heel lever and an anterior surface of the heel block. The heel lever can be tipped between an open position and a closed position.

1 Claim, 18 Drawing Sheets

80
70
130
150
140
40
110
100
90
30
120
10
50
20

STEP-IN TELEMARK SKI BINDING

BACKGROUND OF THE INVENTION

This invention relates to bindings used to connect a user's boot to sports equipment, particularly, but not exclusively, ski bindings, and more particularly, ski bindings used in Telemark skiing.

Telemark skiing, also called "free heel skiing," is a type of skiing characterized by what is referred to as a Telemark turn, which is a turning technique. A Telemark ski binding connects a ski boot to the ski only at the toe, as do cross-country ski bindings. While the present invention is particularly useful in overcoming certain problems currently encountered with Telemark ski bindings, after having read and understood the following description, those of skill in the art will readily appreciate that the scope of the invention encompasses step-in style bindings that attach a user's boot to a wide variety of sports equipment.

Prior art binding systems for Telemark skis include a toe portion, such as a toe iron, for maintaining the toe of a ski boot in a fixed position. A tension cable is adapted to be passed around the heel of the boot and coupled to a tensioning mechanism for fixing the boot toe to the toe iron such that during skiing the boot heel and the heel of the skier's foot may be raised vertically away from the ski. The cable may incorporate elastic, spring, or other elements that vary the effective length of the cable whilst maintaining tension against the boot. The cable may also incorporate a tensioning mechanism, for example, a tightening lever. Alternatively, or in addition, the binding may employ other means for varying the length of the tension cable, such as a screw bolt and a co-operating nut.

Often a heel engagement device is mounted on the top of the ski for engaging the heel of the boot. These devices often include a lever configured to engage the heel of the boot and thereby apply tension to the cable. For instance a groove may be formed on the heel of the boot in which the lever sits.

A major drawback common to most prior art bindings is that they require the user to kneel or squat down to close the binding on each foot. Prior attempts to design step-in bindings, which at least theoretically allow the user to close the binding without use of their hands, suffer from numerous drawbacks, such as mechanical complexity, fragility, high cost and unreliability.

Prior attempts have been made to address these deficiencies, but with little success. For example, French Patent 2,824,747 discloses a binding having a heel lever with a rounded surface. When the user applies downward pressure with the ski boot, the rounded surface of the heel lever is pressed against the heel pad or the top of the ski, causing the heel lever to rotate about the axis of the cable, thereby moving into a closed position about the heel of the boot. The advantage of the '747 patent is that the heel lever includes a hook or catching mechanism that maintains the binding in an open position, ready for the user to step-in.

However, the '747 patent has disadvantages. For instance, in deep snow it is liable to become clogged such that the user must first clear the binding by hand (i.e. negating the advantages of the step-in feature), and it suffers from heel instability. These and other drawbacks have resulted in the '747 design not being widely adopted.

Another drawback of prior art bindings is that, due to the freedom of movement of the heel of the boot, aggressive skiers are liable to "pop out" of the bindings or to have the heels of their boots slide out on hard landings. This is referred to as "heel instability" and occurs when the heel of the boot moves laterally in a direction approximately perpendicular to the longitudinal axis of the binding/ski due to the forces experienced by aggressive skiers, for instance when a skier lands a jump.

Accordingly, it is an object of the present invention to provide a step-in binding that is an improvement over existing bindings, particularly with respect to ease of use and providing lateral heel stability.

SUMMARY OF THE INVENTION

The present invention relates to step-in type boot binding systems. Although applicable to a wide variety of sports and equipment types, the present invention is particularly suited to binding systems for removably attaching a user's boot to snow sports equipment such as Telemark skis, cross country skis, skate skis, and snowshoes. However, the invention has wide applicability and the term "sports equipment" is used in this disclosure and the claims to refer to any sports equipment with which the invention can be used. For reasons of clarity of exposition, the invention is disclosed with respect to skis, particularly Telemark skis.

The invention is particularly useful with boot binding systems wherein the front or toe of the boot is fixed to the sports equipment while the heel of the boot is moveable vertically relative to the upper surface of the equipment and the front of the boot. Use with Telemark skis is a good example of this use.

The invention is a step-in binding that permits a user to engage the binding with the boot so that the sports equipment is reversibly fixed to the boot by applying downward pressure with the boot on the binding. In contrast to prior art bindings, the user need not bend down and close the binding by hand.

The invention may take a number of forms. In two particularly useful embodiments the invention is configured as either an assembled or unassembled step-in binding or a kit for adapting or improving existing prior art bindings to step-in bindings.

The present invention is a boot binding system adapted to be mounted onto sports equipment such as a ski. The binding includes a heel block and a heel lever. The heel block is attached to the ski and may extend from the surface of the ski to a height above an optional heel pad. The heel lever may be adapted to rotate about a pivot point and thereby assume either an open position in which it frictionally engages the boot heel, or, alternatively, a closed position in which the lever and the boot heel are disengaged from each other. The lever has a camming surface.

The heel block has a substantially forward facing anterior surface that is adapted to frictionally engage the camming surface of the heel lever when the boot is secured to the ski. The boot heel is therefore reversibly held to the ski by the frictional forces between the boot heel and the heel lever, and between the heel lever and the heel block.

The heel block anterior surface may optionally form a channel, which may be, for instance, U- or V-shaped. The channel engages a complimentary or mating camming surface of the heel lever when the heel lever is closed against the heel of the boot. The channel acts as a guide for engaging the heel lever and heel block, and as a restraint to prevent lateral movement of the heel of the boot when a skier is skiing. For instance, the channel may be wider at one end and narrower at the other so that the heel lever and heel block will have the tendency to "funnel" one another into a centered alignment in the binding as the heel of the boot comes down towards the heel pad when a skier is skiing or stepping into the binding. Alternatively, the heel lever may incorporate a channel that engages a complimentary or mating ridge or functionally equivalent feature of the heel block.

The binding has a toe portion that reversibly receives the toe of the boot. The toe portion can be any appropriate device or mechanism such as a toe plate, toe iron, or toe box that engages the toe of the boot. Many such devices are well known in the art. When engaged with the toe of a ski boot, the toe portion of the binding maintains the toe of the ski boot in a fixed position relative to the ski, although in some configurations the toe of the boot can pivot about an axis while fixed to the ski. The precise configuration of the toe portion may vary according to various designs known in the art and the desires or preferences of the user or manufacturer without effecting the scope of the invention.

A U-shaped cable may extend rearward from the toe portion of the binding. The free ends of the cable are fixed to the sides of the toe portion and at the closed portion of the "U" reversibly encircles the heel of the boot. The heel lever may be pivotally attached to this portion of the cable. When the user presses down on the heel lever with the heel of the boot when stepping into the binding, the heel lever rotates about the cable, which forms a pivot point for the heel lever. This motion closes the lever, forcing it into frictional engagement with the boot, and simultaneously the camming surface of the lever is forced into frictional engagement with the anterior surface of the heel block, thereby securing the heel to the sports equipment.

The binding optionally includes a heel pad attached to the sports equipment. The heel pad supports the heel of the boot and protects the equipment from impact and abrasion by the boot. The heel pad may be continuous with the heel block.

The heel block may additionally include snow escape feature that permits snow to exit the binding. The snow escape feature may include, for instance, a bore such as a hollowed-out portion or tunnel through the heel block, through which snow is forced by the boot when the user steps down onto the heel pad, either when skiing or when stepping into the binding. Alternatively, the snow escape feature may a narrow profile of the heel block like a blade that allows snow to pass by.

The heel pad can be configured to "grip" or otherwise engage the heel of the boot such that the heel is prevented from sliding out laterally. Such a configuration can also allow snow to exit the binding and/or to exit the space between the boot and the ski. For example, the heel pad can include a number of ridges, teeth or points (separated by spaces or channels) such that the tops of the ridges engage the boot and the snow is pressed down between the ridges by the boot. The channels between the ridges may be sloped so as to direct the snow laterally and away from the longitudinal centerline of the binding/ski.

The binding may optionally include a locking mechanism whereby the heel lever and the heel block of the binding are configured to mutually engage one another such that the cable and heel lever are held in the open position and the binding is ready to receive the ski boot when the user steps into the binding. As is described in further detail below, such locking mechanism may take the form of a magnetic coupling, ball and socket coupling, or their functional equivalents.

The precise curvature, size and position of the camming surface of the heel lever relative to the cable bore can vary according to the user's preference, user's skiing ability, configuration of the heel block of the binding. Similarly, the precise curvature, size and positioning of the heel block can also vary according to the user's preference, user's skiing ability, and configuration of the heel lever.

One of skill in the art will readily appreciate from this disclosure that the various components of the binding can be made from a variety of appropriate materials such as plastic, aluminium, titanium, composite materials, carbon fiber.

The toe portion of the binding, the heel pad and the heel block can be affixed to the ski or other sports equipment by a variety of appropriate means that will be readily apparent to persons skilled in the art.

The height and orientation of the heel pad and toe box can vary according the preference of the skier and may incorporate any appropriate prior art features and designs.

The cable can have varying degrees of elasticity according to the height, weight, skiing ability and preferences of the user. The cable can be softwire or hardwire. It may incorporate cable, wire, rope (e.g. nylon), and/or spring components as appropriate. Although the traditional cable design of Telemark binding is primarily shown herein, the cable can also be of the underfoot design, single or double cartridge, or any other appropriate design known in the art.

BRIEF DESCRIPTION OF THE DRAWINGS

A ski binding according to the invention is disclosed herein in detail with reference to the accompanying drawings, in which.

DETAILED DESCRIPTION OF ILLUSTRATIVE EMBODIMENTS

Basic Components

Figure 1:
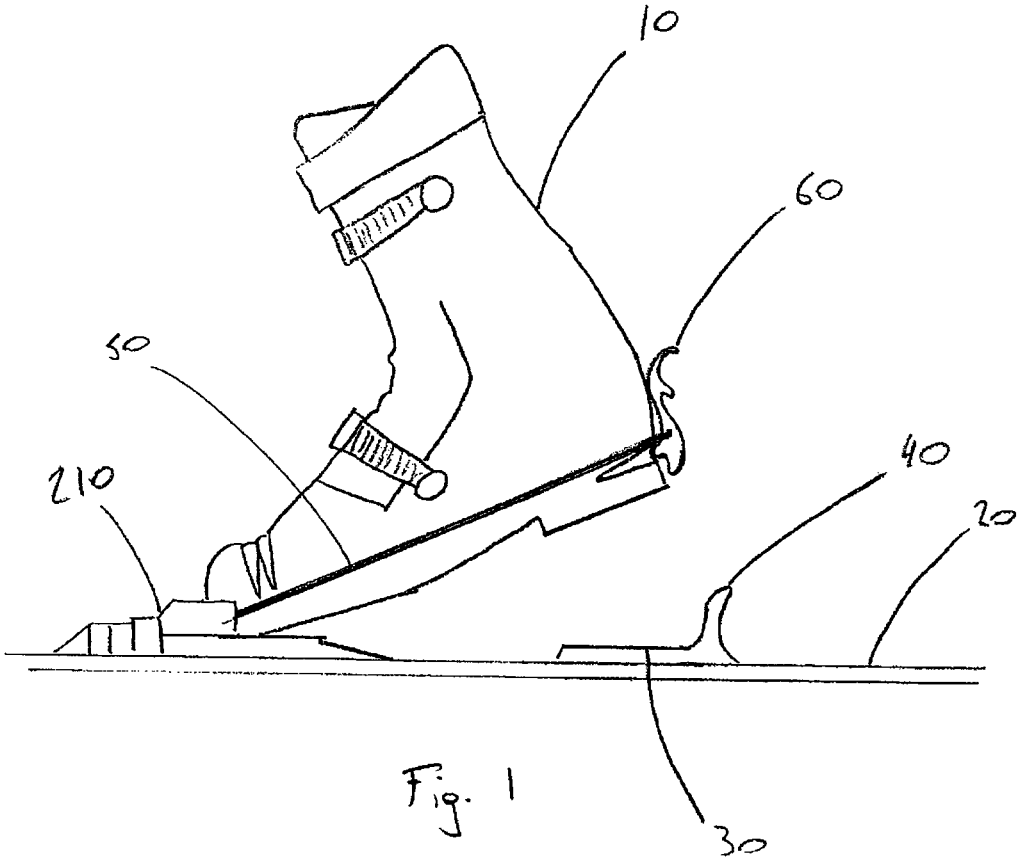
FIG. 1 is side view of a ski, ski boot, and ski binding according to one embodiment of the invention.
Figure 2:
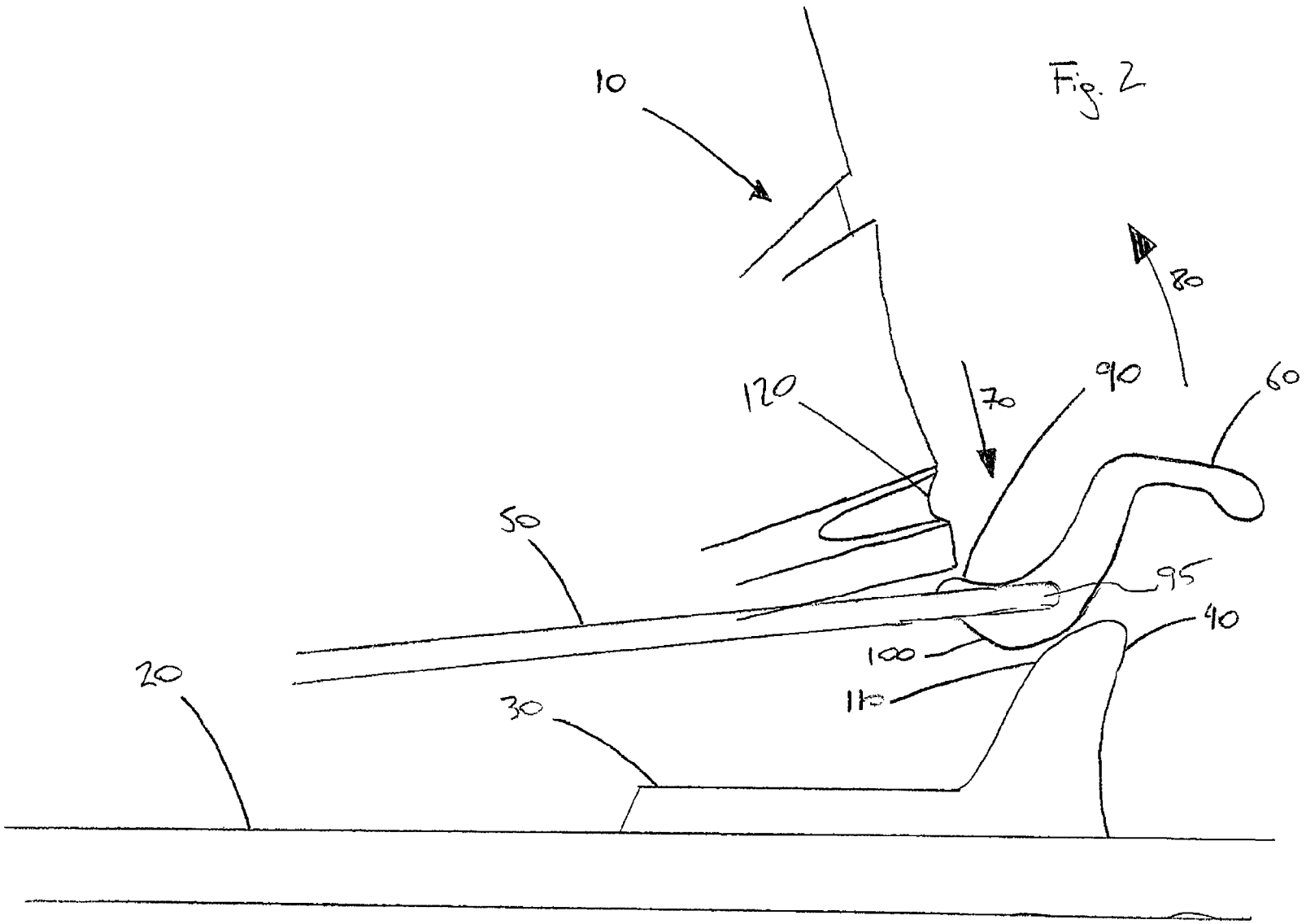
FIG. 2 is a partial side view of a boot heel and the rear portion of one embodiment of the binding of the present invention.

FIG. 1 is provided to indicate the structural context of the invention. A ski binding according to one embodiment of the invention is shown attached to a ski 20. The binding comprises a toe portion 210, a cable 50, a heel lever 60, a heel pad 30, and a heel block 40. Boot 10 is shown with its toe received and secured by the binding toe portion 210. The heel of the boot is shown lifted free of the binding, but the boot is secured to the toe portion by means of cable 50. As is well known in the art, the ends of cable 50 are secured to the toe portion 210. The cable thus forms a "U" with the closed portion of the "U" reversibly encircling the heel of the boot. The cable passes through heel lever 60 and provides a pivot point about which the lever rotates, as described in detail below. The cable shown in FIG. 1 runs along either side of the boot; however, the invention can be used with alternative cable systems, such as an underfoot cable system wherein the cable runs under the boot.

In FIGS. 2-13 the front of the boot and the front of the binding (i.e. the toe bail, toe box, toe iron, riser, etc.) are not shown as these components of the invention are not novel or unique to this invention. For illustrative purposes the terms "clockwise" and "counter-clockwise" are used with respect to FIGS. 1-13. These terms do not refer to absolute directions of rotation. In FIGS. 1-13 and 18 the anterior (toe) portion of the device is to the left and the posterior (heel) portion is to the right.

In FIGS. 2, 4, 6, 8, 10 and 12 the various embodiments of the heel lever are shown in an open configuration, with arrows 70 and 80 indicating the direction of motion of the boot heel 10 and the direction of rotation of the rotatable heel lever 60 towards a closed configuration. In FIGS. 3, 5, 7, 9, 11 and 13 the various embodiments of the heel lever in the closed or nearly closed configuration are shown in which the heel lever 40 is frictionally engaged or becoming engaged with the heel of the boot 10.

In the embodiments of FIGS. 1-5 the heel pad 30 and heel block 40 are a single unitary component. In the embodiments of FIGS. 6-13 the heel pad 30 and heel block 40 are two separate components.

Open and Closed Configurations

Referring to FIGS. 2, 4, 6, 8, 10 and 12, the features of the invention in the open configuration can be appreciated. There is provided a ski binding having a heel lever 60 that is attached to a cable 50, the cable being also attached to a toe portion of the binding (See FIG. 1, 210.) The cable may pass through the heel lever, thereby providing a pivot point or point of rotation of the rotatable heel lever. The heel lever has a lower part, referred to herein as the lower extremity 90.

Also provided is a heel block 40 having an anterior surface 110 with which a camming surface 100 of the heel lever interacts, as described below. The binding may optionally include heel plate 30 as commonly found in ski bindings. The heel plate may be structurally continuous with the heel block or separate.

Figure 3:
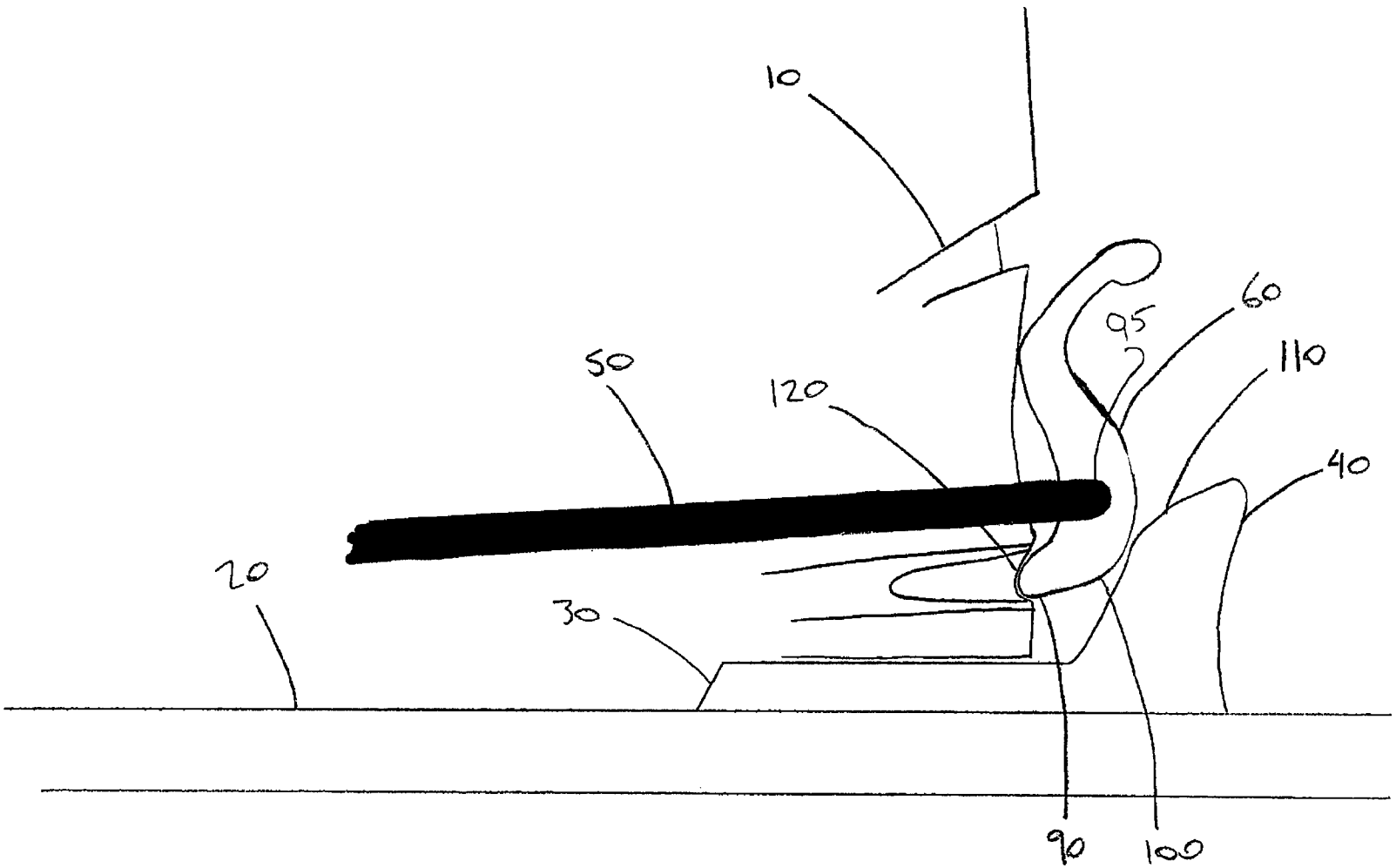
FIG. 3 is a partial side view of a boot heel and binding of FIG. 2, where the binding is closed on the heel of the boot.
Figure 4:
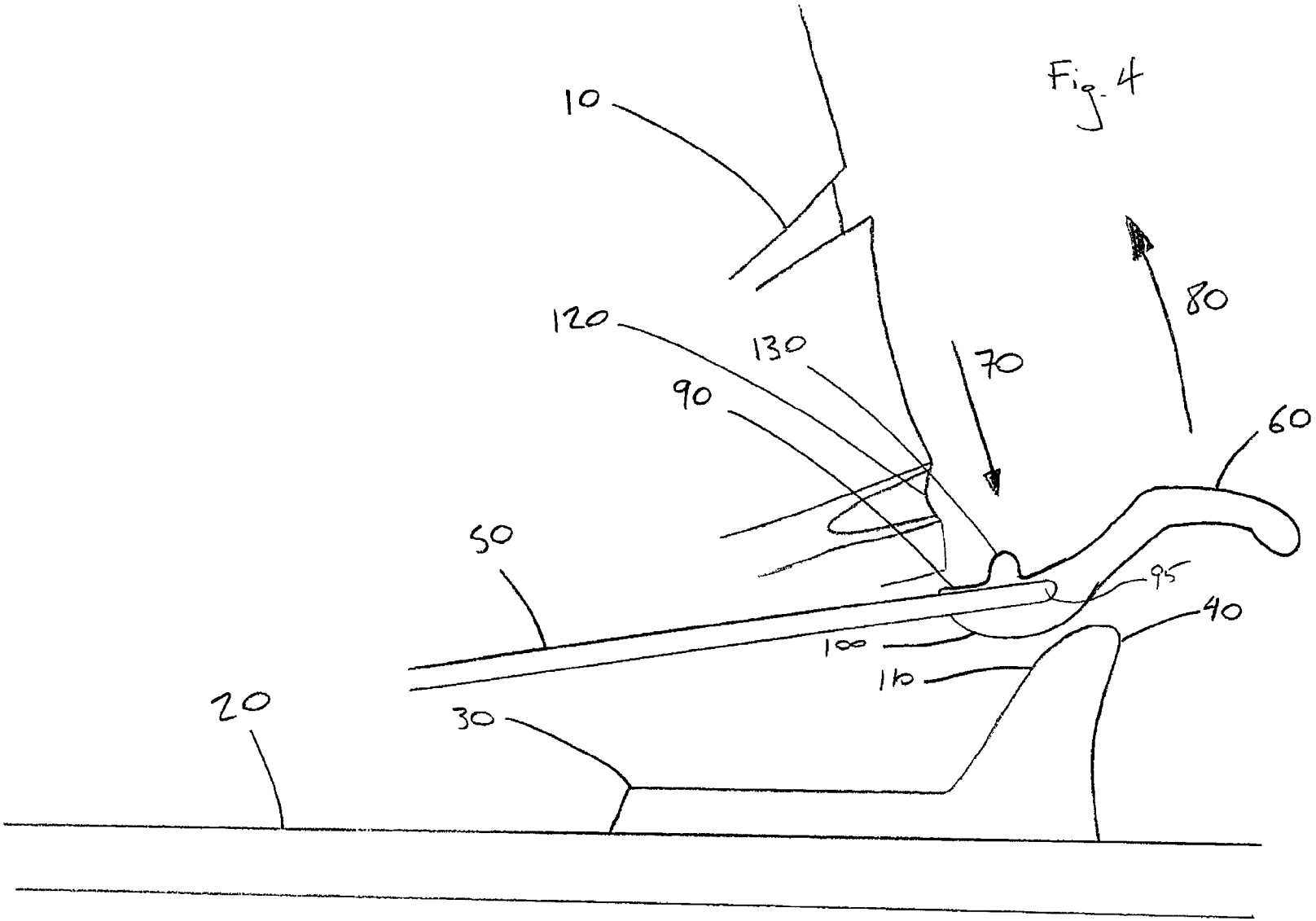
FIG. 4 is a partial side view of a boot heel and the rear portion of another embodiment of the binding of the present invention.
Figure 5:
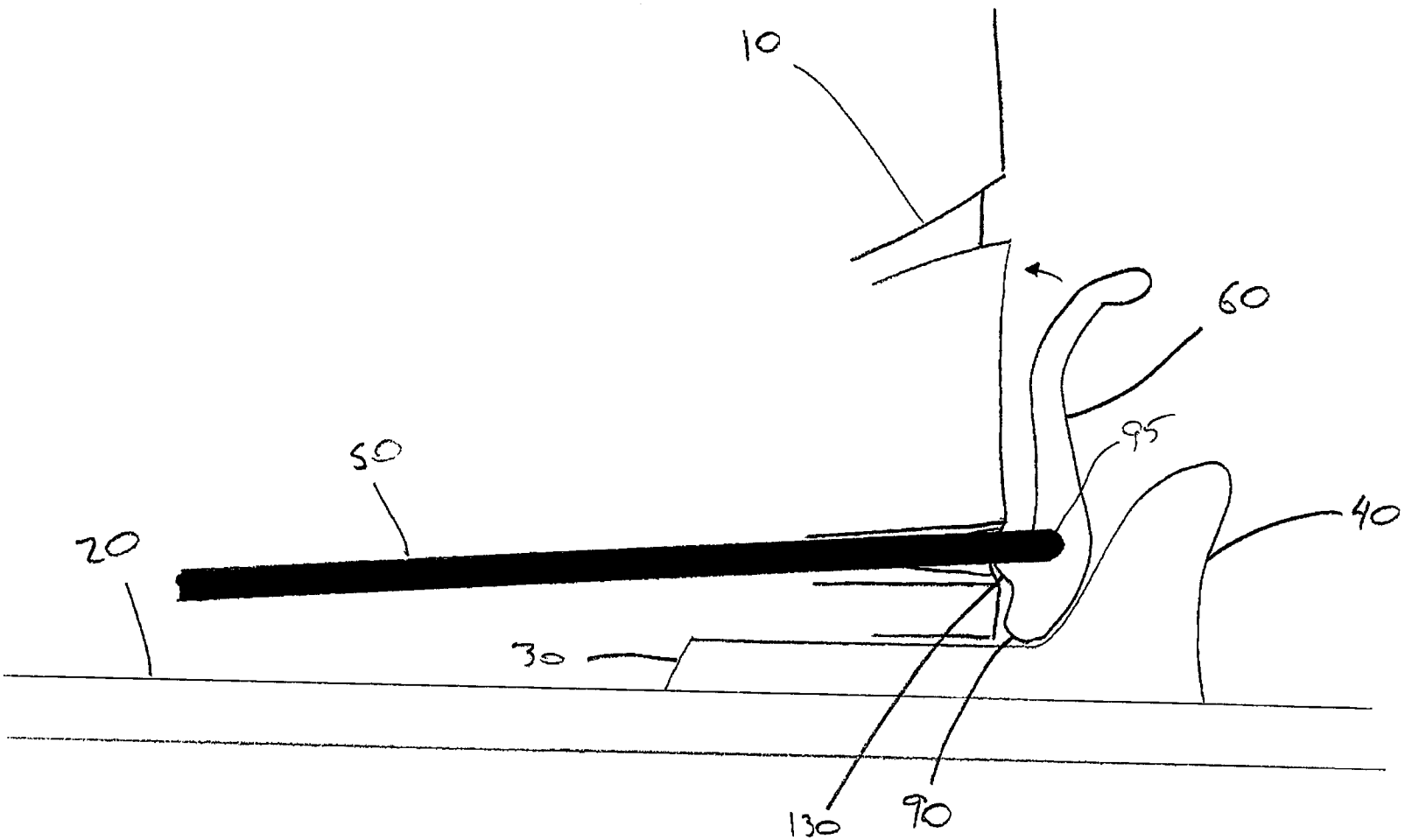
FIG. 5 is a partial side view of a boot heel and binding of FIG. 4, where the binding is closed on the heel of the boot.
Figure 6:
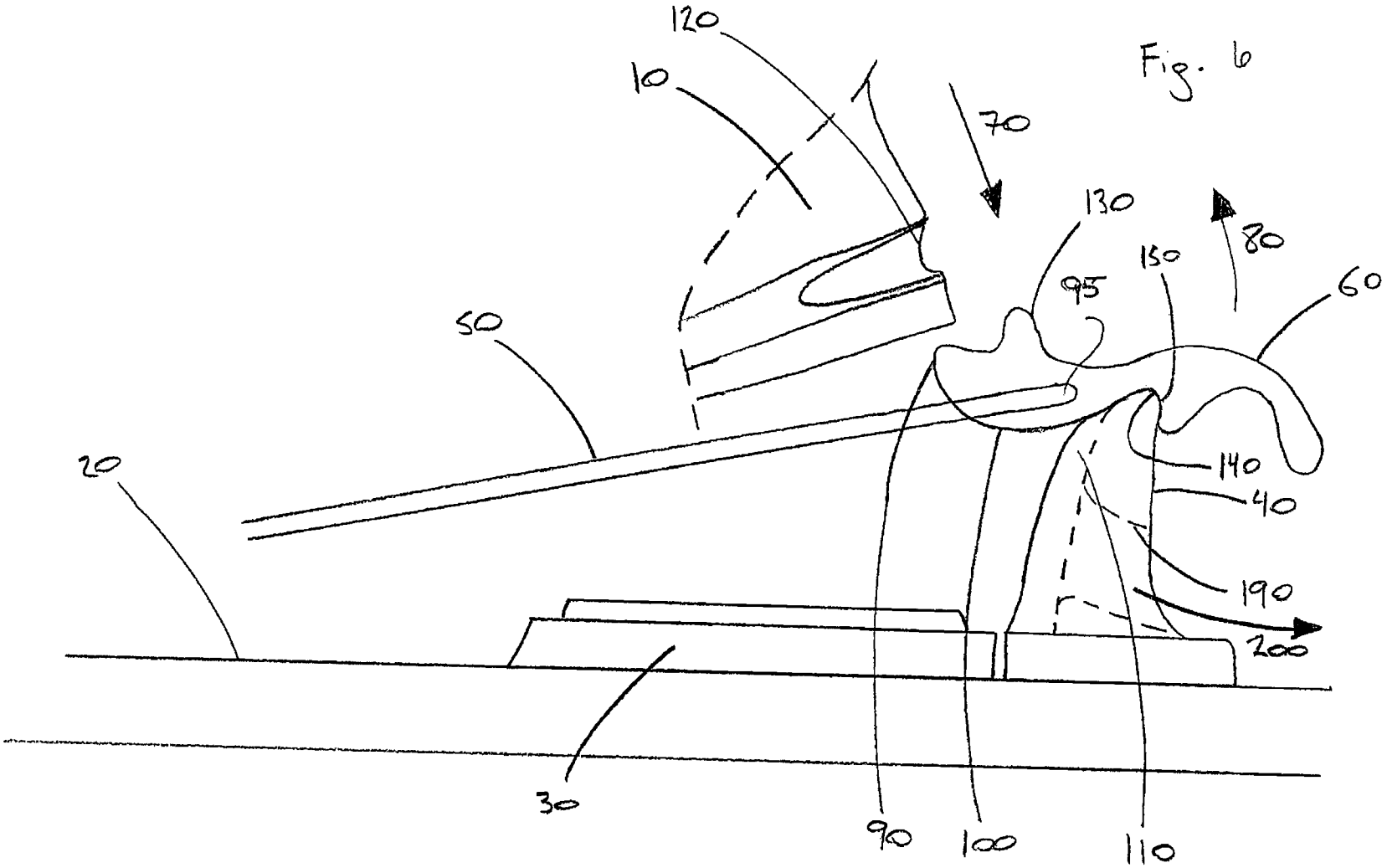
FIG. 6 is a partial side view of a boot heel and the rear portion of another embodiment of the binding of the present invention.

Referring to FIG. 4 or 6, the heel lever is converted from an open configuration to a closed configuration as follows. The user engages the toe of the boot with the toe portion of the binding, which receives the toe (not shown). The user then applies downward pressure to the heel of the boot 10 causing the heel of the boot to move in the direction of arrow 70 and to come into contact with the lower extremity 90 of the heel lever 60. As the heel of the boot continues downward, it presses against the lower extremity 90 of the heel lever 60, forcing the camming surface 100 of the heel lever 60 against the anterior surface 110 of the heel block 40 and causing the heel lever 60 to rotate counter-clockwise about the pivot point 95 formed by the attachment with the cable 50. As the heel lever 60 rotates, the lower extremity 90 initially moves in the direction of arrow 70 and the upper extremity of the heel lever initially moves in the direction of arrow 80. As the heel of the boot 10 continues downward, it forces the heel lever 60 downwards into a closed configuration shown in FIGS. 3, 5, 7, 9, 11 and 13. Upon removing the boot heel from contact with the heel lever, the lever is allowed to rotate in the opposite direction, thereby assuming the open configuration. Thus, by virtue of its rotation about the pivot point, the heel lever is reversibly converted from an open configuration to a closed configuration.

In the closed configuration of the heel lever, as shown in FIGS. 3 and 5, the lower extremity 90 of the heel lever 60 is shaped in a manner complementary to the groove or indentation 120 of the boot. The lower extremity 90 is forced into frictional engagement with the groove 120 by a combination of the tension of the cable 50, and the stationary heel block 40. As the heel of the boot 10 moves downwards relative to the heel block 40, the heel lever 60, in addition to rotating about the cable 50, is forced upwards along the heel of the boot 10 (i.e. by upwards it is meant that the heel lever moves or slides along the boot in direction from the sole of the boot towards the top of the boot). As the heel lever moves upwards along the boot, the lower extremity 90 engages the groove 120, at which point the tension of the cable 50 pulls the lower extremity 90 into the groove 120. The binding is configured, and its various components positioned, such that the heel block 40 prevents the heel lever 60 from moving in a downward direction with the heel of the boot 10. The heel lever is thus forced upwards along the surface of the boot as the boot moves downward toward the ski and/or heel pad. In this manner the heel block 40 forces the heel lever 60 into engagement with the groove 120 of the boot as the boot heel descends. As the sole of the boot bottoms out (i.e. comes to rest on the heel pad 30) the lower extremity 90 of the heel lever 60 becomes engaged with the groove 120 of the boot heel. The heel lever is then in the closed configuration.

Heel Lever Flange

Referring to FIGS. 4-13, shows an alternative heel engagement mechanism in which the heel lever 60 is shown having an optional flange 130 adapted to engage the groove 120 of the boot. In these embodiments, in contrast to that of FIGS. 1 and 3, the lower extremity 90 of the heel lever 60 is not intended to engage the groove 120. Rather, the lower extremity 90 acts merely as a contact point on which the sole of the boot exerts downward pressure, causing the heel lever 60 to rotate so that the flange 130 comes into engagement with the groove 120. In this embodiment of the invention the heel lever 60 does not slide (or slides considerably less) upwards along the surface of the boot.

Figure 17:
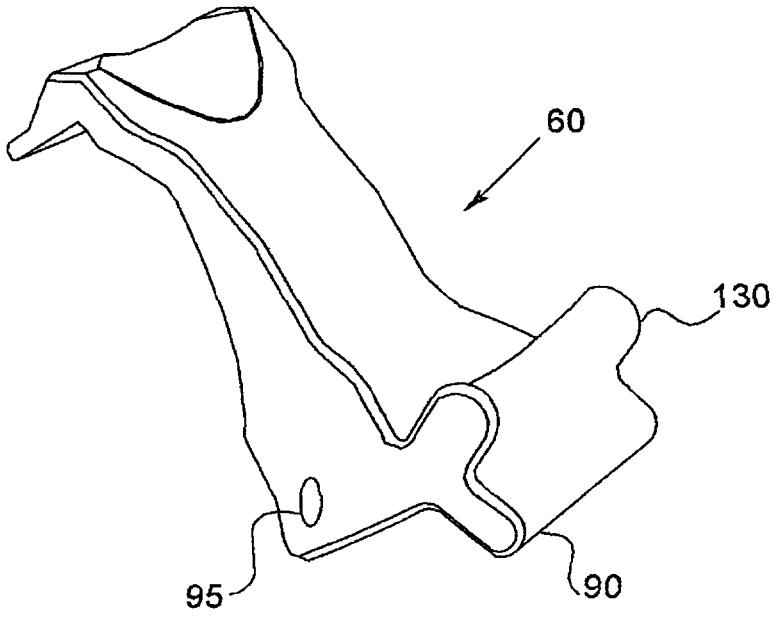
FIG. 17 is perspective view of a heel lever according to the invention.

In FIG. 17 a heel lever 60 is shown in isolation of other components of the binding so the distinction between the lower extremity 90 and the flange 130 is obvious. Also shown in FIG. 17 is the pivot point 95 of the lever. The pivot point in the embodiment shown is a hole through the heel lever through which the cable runs, thereby allowing the heel lever to pivot about the cable.

Locking Mechanism

Referring to FIGS. 6-13, various embodiments of the invention are shown that include optional locking mechanisms that reversibly locks the heel lever 60 in an open position, ready to receive the heel of the boot 10. The embodiments of FIGS. 1-5 rely primarily on the rigidity of the cable 50 to maintain the heel lever 60 in an open position where it is ready to receive the heel of the boot. The advantage of the locking mechanism embodiments of FIGS. 6-13 is that the heel lever 60 is reversibly and firmly held in the open position and therefore is less likely to be accidentally dislodged, thereby requiring the user to reset the binding.

In FIGS. 6, 7, 12 and 13, the locking mechanism comprises the heel lever 60 and heel block 40 incorporating a point 140 and matching catch 150 that are complementary in shape and engageable with one another. When the point 140 and catch 150 are engaged, the cable 50 is tensioned and the heel lever 60 maintained in an open position. When the heel of the boot 10 forces the lower extremity 90 of the heel lever 60 downwards, the heel lever 60 is caused to rotate, causing the point 140 and catch 150 to disengage.

Figure 8:
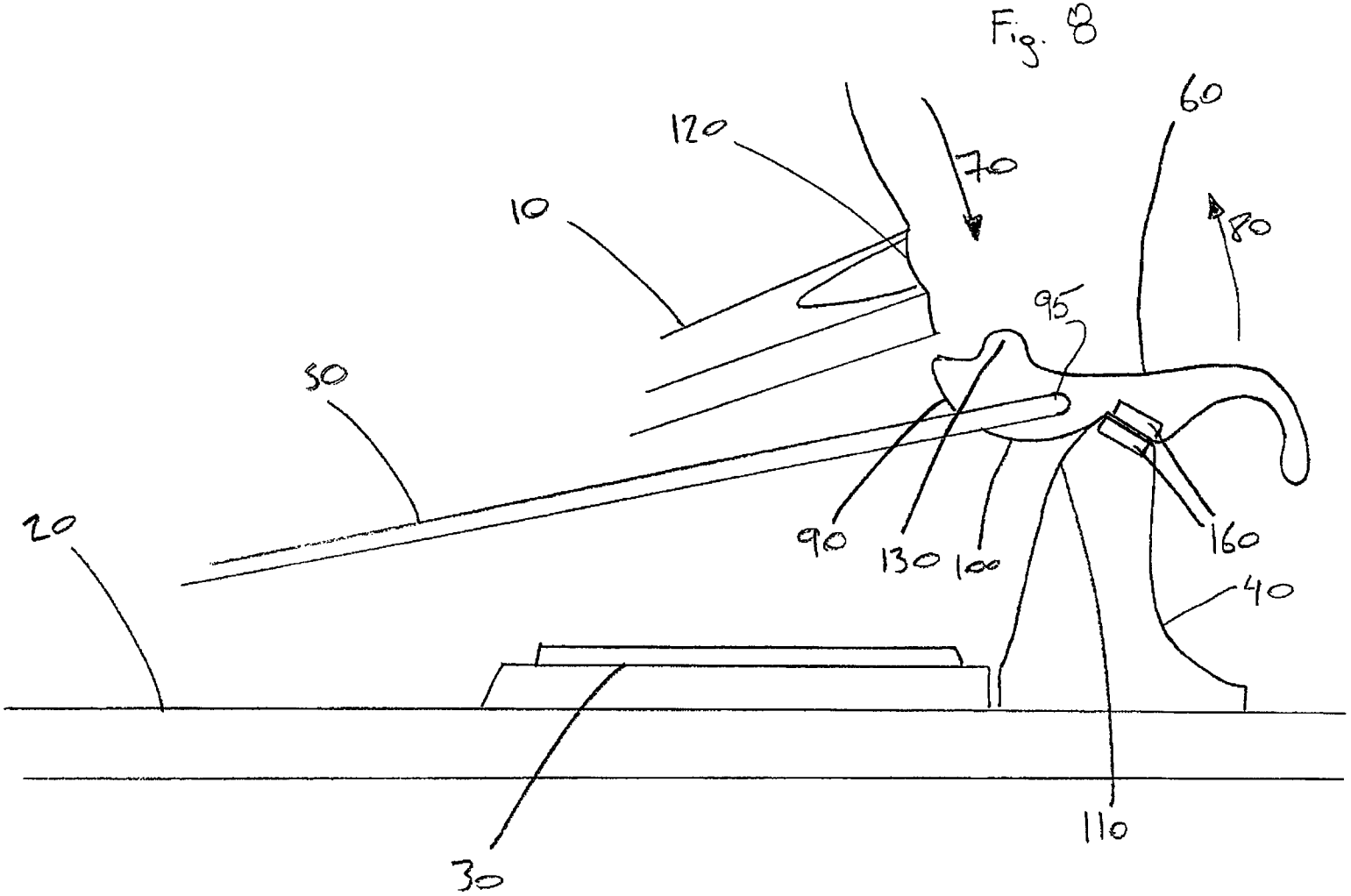
FIG. 8 is a partial side view of a boot heel and the rear portion of another embodiment of the binding of the present invention.
Figure 9:
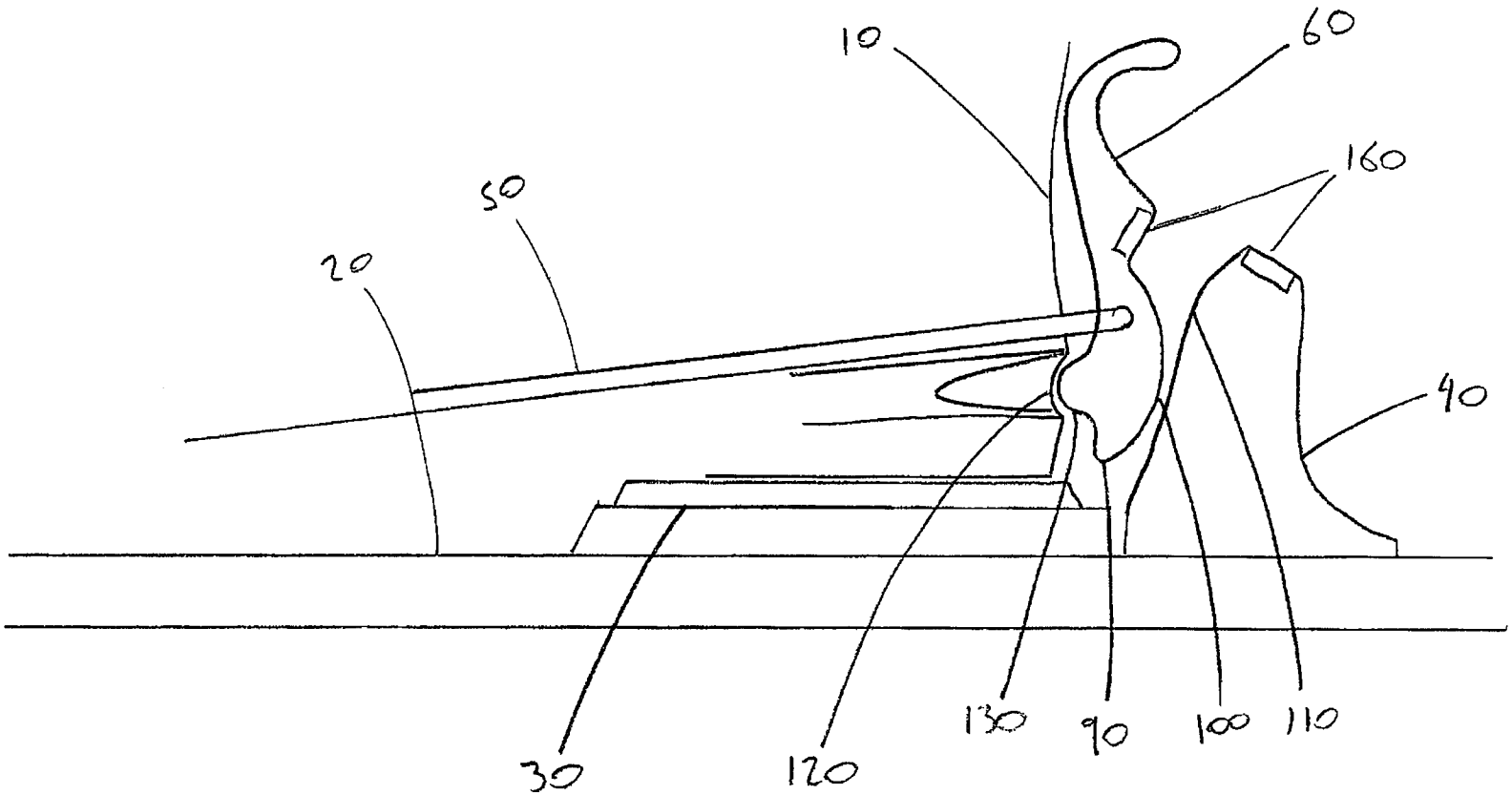
FIG. 9 is a partial side view of a boot heel and binding of FIG. 8, where the binding is closed on the heel of the boot.

With respect to the locking mechanism embodiment shown in FIGS. 8 and 9, the heel lever 60 and heel block 40 include a magnetic assembly in which a pair of magnets 160 (or a magnet and a piece of metal attracted by a magnet) maintain the heel lever 60 and cable 50 in an open position. As the boot 10 is pulled free from the binding, heel lever 60 rotates in a clockwise direction under the influence of cable 50 or gravity. As magnets 160 come into juxtaposition, they are engaged through a magnetic force and hold the binding open until the boot is re-inserted into the binding. By holding the binding open, the magnetic assembly overcomes a major short-coming of prior art bindings.

Figure 10:
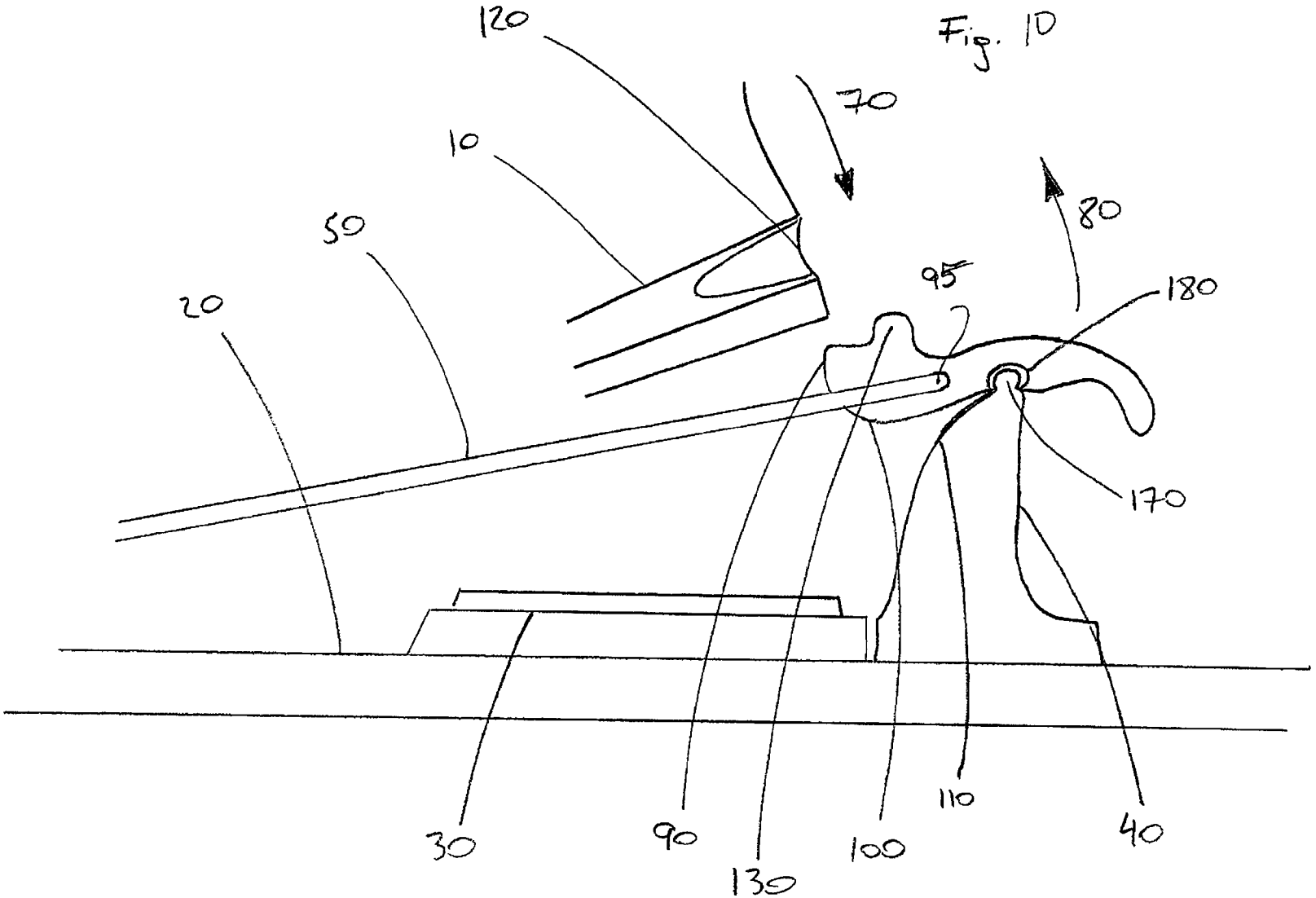
FIG. 10 is a partial side view of a boot heel and the rear portion of another embodiment of the binding of the present invention.
Figure 11:
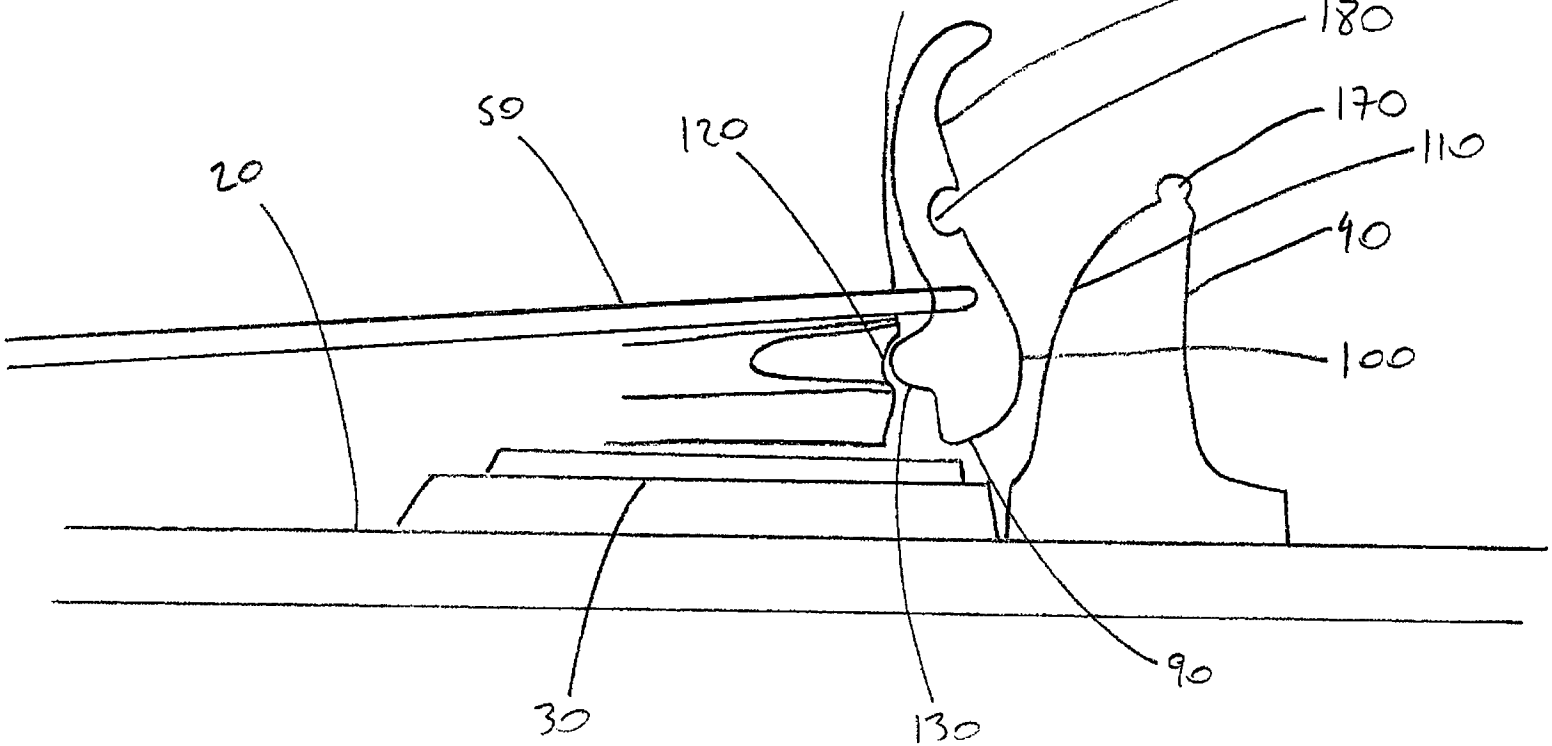
FIG. 11 is a partial side view of a boot heel and binding of FIG. 10, where the binding is closed on the heel of the boot.

With respect to an locking mechanism embodiment shown in FIGS. 10 and 11, the heel lever 60 and heel block 40 include a ball 170 and socket 180 connection that maintains the heel lever 60 and cable 50 in an open position. As the boot 10 is lifted out of the binding, heel lever 60 rotates in a clockwise direction until socket 180 frictionally engages ball 170. The binding is thereby held in an open position until the boot is placed back in the binding, forcing heel lever 60 to rotate counter-clockwise, thereby forcing the ball and socket connection to break. Of course, the ball and the socket can be interchanged with respect to their positions on the heel lever and heel block 40.

Numerous alternative locking mechanisms for engaging the heel block 40 and heel lever 60 and maintaining the heel lever in an open position will be readily apparent to persons skilled in the art upon reading this disclosure.

Mating Camming and Anterior Surfaces

Figure 7:
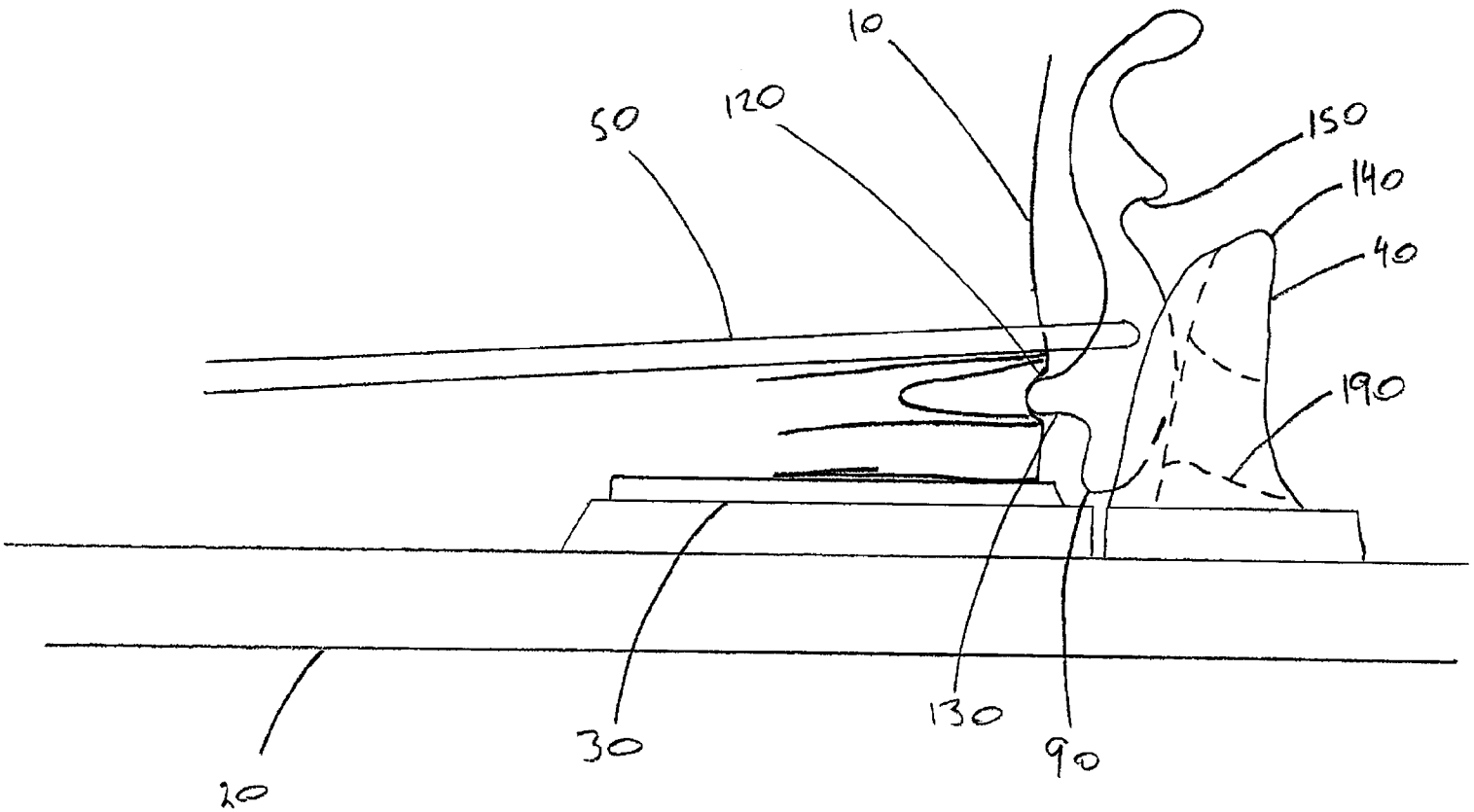
FIG. 7 is a partial side view of a boot heel and binding of FIG. 6, where the binding is closed on the heel of the boot.
Figure 15:
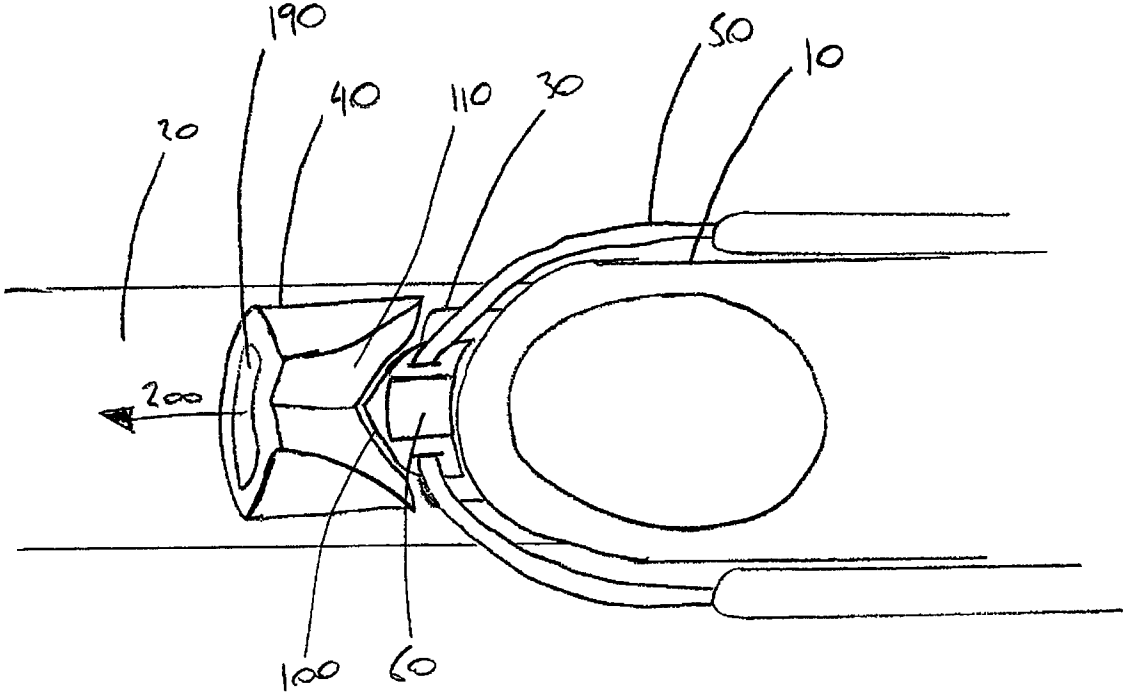
FIG. 15 is a top view of the rear portion of one embodiment of the binding, where the binding is closed on the heel of the boot.

Referring again to FIGS. 6, and 7, and to FIG. 15, an embodiment of the invention is shown wherein the camming surface 100 of the heel lever 60 and the anterior surface 110 of the heel block 40 have complementary V-shaped profiles such that the camming surface 100 mates with the V-shaped groove of the anterior heel block surface 110. These complementary profiles of the interacting surfaces help to maintain the heel of the boot 10 in proper alignment by preventing lateral movement of the heel lever, and therefore lateral movement of the heel itself. This reduces or minimizes heel instability and helps to prevent users from popping out of their bindings when using the sports equipment aggressively. FIGS. 7 and 15 both show the binding in the closed position.

Figure 12:
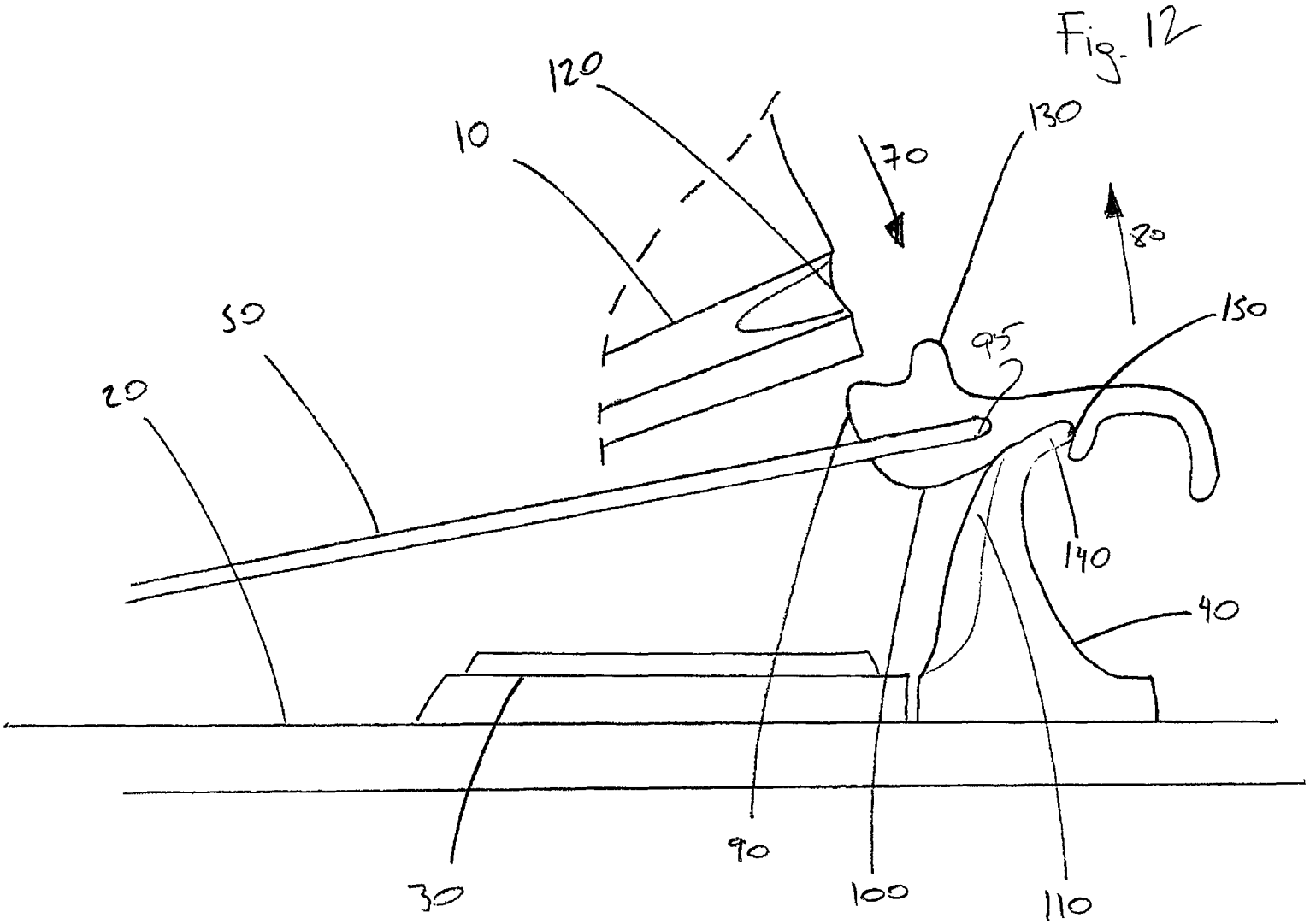
FIG. 12 is a partial side view of a boot heel and the rear portion of another embodiment of the binding of the present invention.
Figure 13:
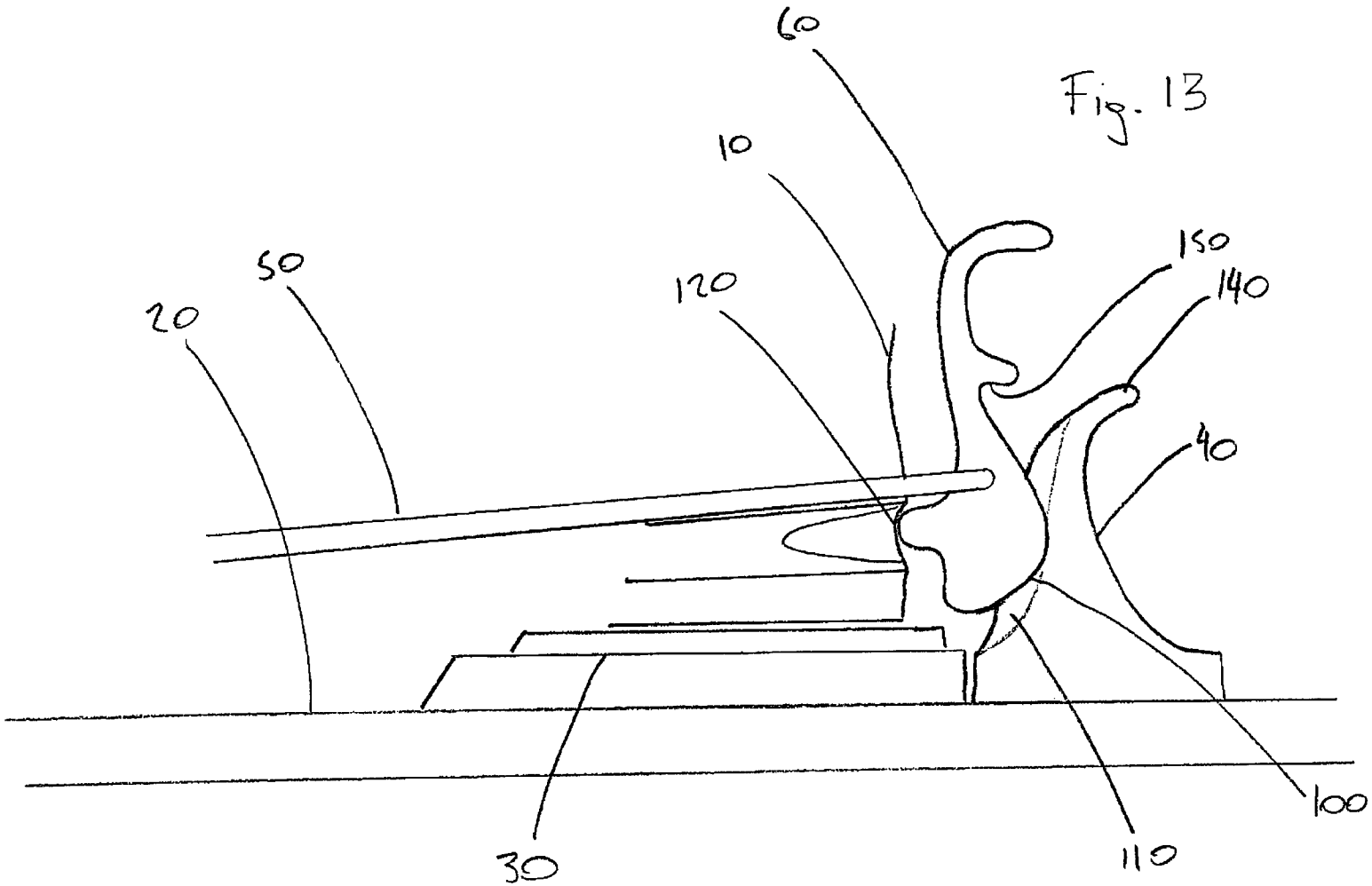
FIG. 13 is a partial side view of a boot heel and binding of FIG. 12, where the binding is closed on the heel of the boot.
Figure 14:
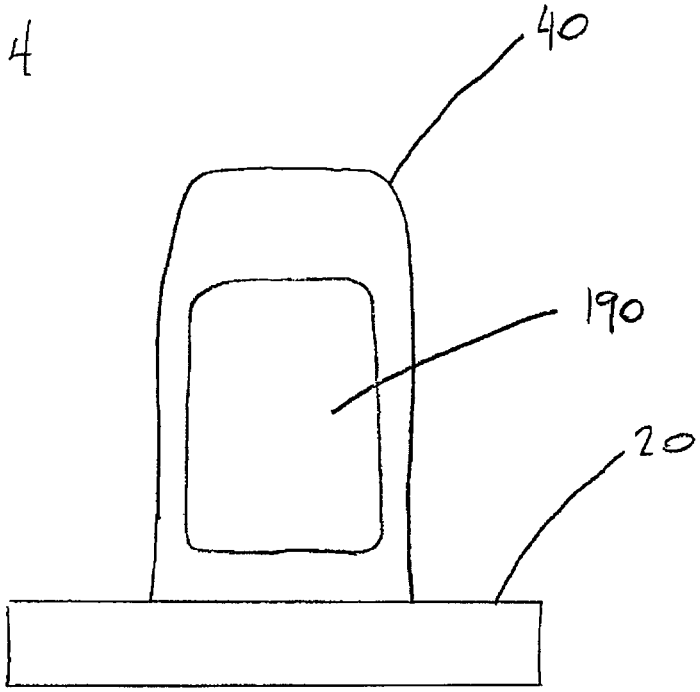
FIG. 14 is a rear view of one embodiment of the heel block of the invention.
Figure 16:
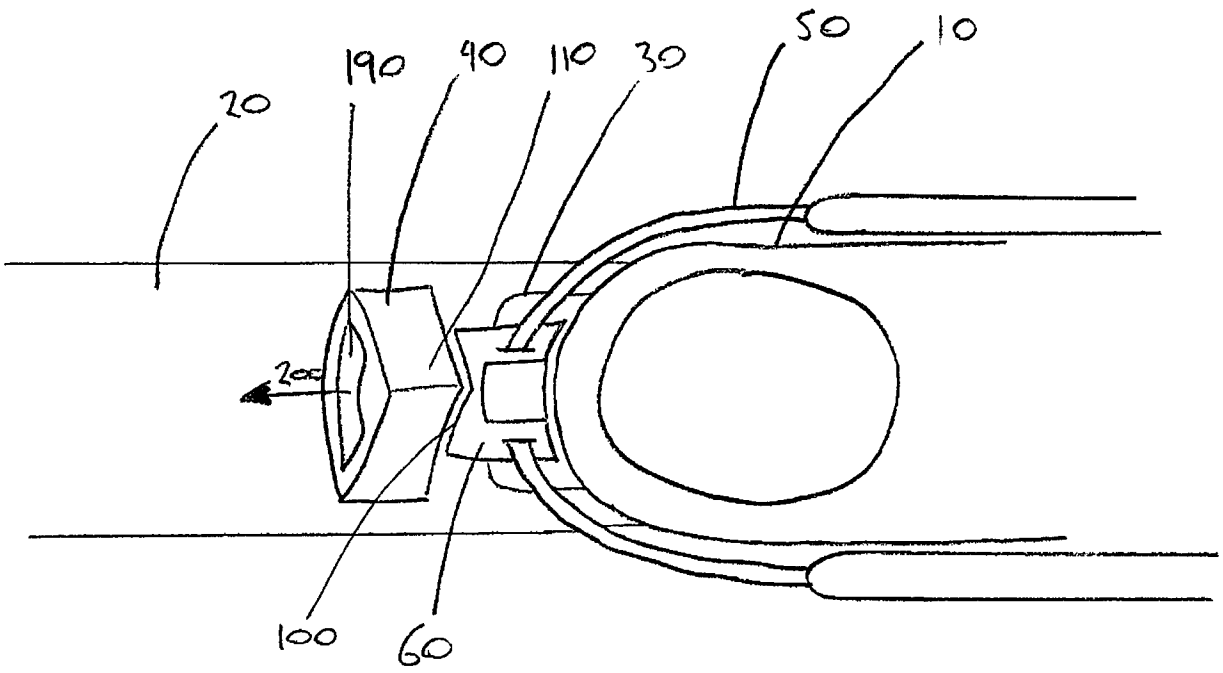
FIG. 16 is a top view of the rear portion of another embodiment of the binding, where the binding is closed on the heel of the boot.

Referring to FIGS. 12, 13, and 16, another embodiment of the invention is shown wherein the camming surface 100 of the heel lever 60 and the anterior surface 110 of the heel block 40 have complementary V-shaped profiles such that the anterior surface 110 mates with the V-shaped groove of camming surface 100. As with the embodiment of FIGS. 6, 7, and 15, this complementary profile helps to maintain the heel of the boot 10 in proper alignment by preventing lateral movement of the heel lever, and therefore lateral movement of the heel itself. FIGS. 13 and 16 both show the binding in the closed position.

Numerous alternative complementary profiles of the camming surface 100 and the anterior surface 110 within in the scope of this disclosure will be readily apparent to persons skilled in the art. The invention is not intended to be limited to the specific designs shown herein.

Snow-Escape Mechanism

Figure 19:
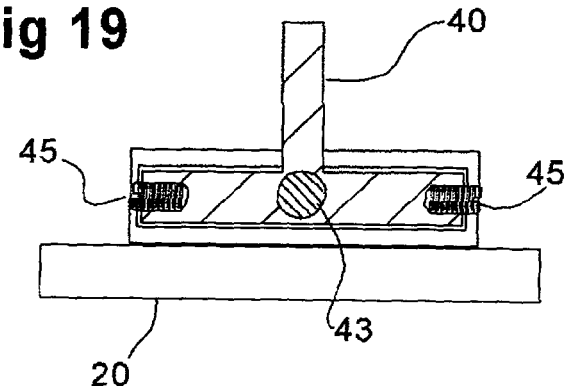
FIG. 19 is a cross-section of the adjustment mechanism of FIG. 18.

When the invention is used with snow-related sports equipment, snow trapped in the binding, particularly between the boot and the heel pad, can impede a skier's ability to ski. It can also impede a skier's ability to step into the binding. Consequently, embodiments are provided with an optional snow escape mechanism that minimizes snow build-up and obstruction. Referring to FIGS. 6, 7, and 13-16, embodiments of the invention are shown wherein the heel block 40 includes a snow escape mechanism in the form of bore 190. Egress of snow through the bore is indicated by arrow 200. The bore 190 allows snow in the binding an escape route when the heel of the boot 10 descends toward the heel pad 30, either when stepping in to the binding or when skiing through deep snow. As an alternative to the bore 190, the snow escape means may be providing a heel block with a narrow profile such as is shown in FIG. 19. The narrow profile allows snow to pass to either side of the heel block and the heel block acts as a blade slicing through the snow.

Retro-Fit Kit

The invention can be provided to end-users either as pre-attached to the sports equipment as a package at the time of sale or as a retro-fit kit. Generally, when installing the retro-fit kit, the existing toe portion of the existing binding can be retained. If the existing binding employs a heel lever attached to the cable, the former lever is easily replaced by the heel lever 60 of the invention. Similarly, the existing heel block or heel block/heel pad combination is swapped out for the heel block 40 of the invention, with or without a heel pad 30 according to the user's preferences and needs. This procedure can be done by a consumer with basic knowledge of power tools, or, preferably, by a licensed technician.

Adjustment Mechanism

An adjustment mechanism for adjusting the position of the heel block on the sports equipment surface may be provided. Such mechanisms are well known in the art of, for instance, ski bindings. The purposes of such adjustment mechanisms in the present invention are 1) to adapt the binding to different boots and boot lengths, and 2) to compensate for wear between the heel lever camming surface and the heel block anterior surface.

Figure 18:
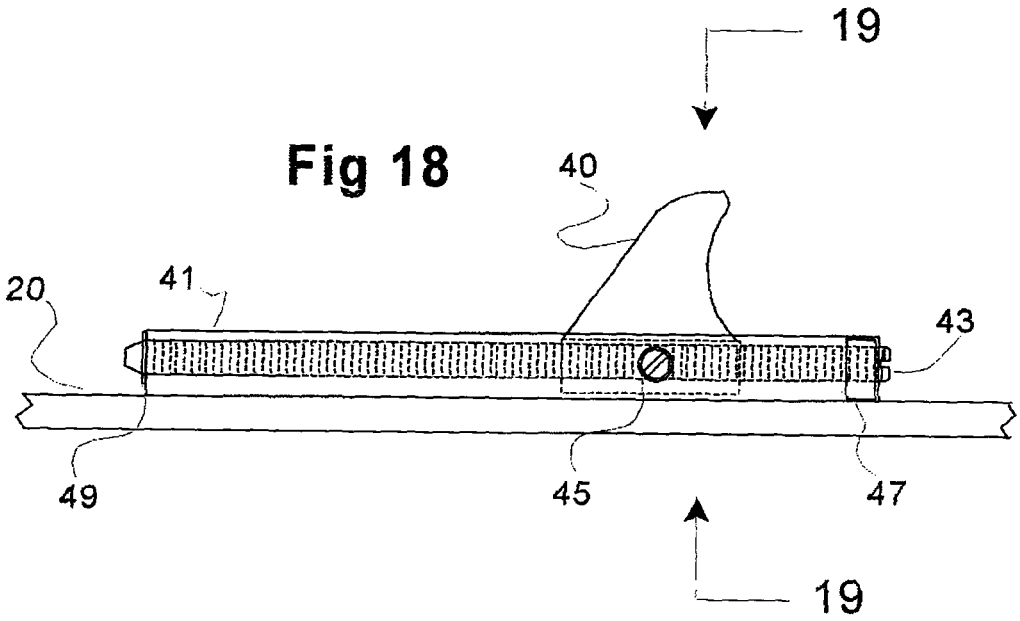
FIG. 18 is a side elevation of a heel block and adjustment mechanism of the present invention.

One embodiment of such an adjustment mechanism is shown in FIGS. 18 and 19. Heel block 40 is connected to ski 20 by a travel device 41, which is attached to the ski by screws or one of other suitable means that are commonly used in the art. In this example, the travel device is a box within which the heel block travels to and fro. The heel block has a cross-sectional profile of an inverted "T." The forward portion of the travel device may act as a heel pad, upon which the boot heel rests.

The heel block has a threaded orifice for receiving threaded rod 43, which also passes through a nylon lock-nut 47. The forward end of the threaded rod is rotatably received by a circlip 49. Rotation of the threaded rod causes the heel block to move to and fro along the length of the travel device. A securing means, such as set screws 45, are used to secure the heel block at its desired position. The set screws in FIGS. 18 and 19 are shown as horizontal, but they can also be vertical.

The foregoing is but one example of many adjusting mechanisms that fall within the scope of the invention. For instance, the travel device may have a "T" cross section and the heel block may form a mating cavity that slides along the "T." An additional or alternative approach is a mechanism for move the anterior surface 110 of the heel block 40 independently of the entire heel block in order to provide a finer adjustment than permitted by the traveler mechanism alone. Upon reading this disclosure, other alternatives will become obvious to those skilled in the art.

Method of Use of a Preferred Embodiment

The invention is used to reversibly attach a boot to sports equipment in the following manner. The heel block is attached to the gear. The heel lever is attached to the cable in those embodiments employing a cable mounted heel lever. If necessary, adjustments are made in the position of the heel block. The boot toe is brought into juxtaposition with the toe portion of the binding and engaged by the toe portion. As the boot heel is lowered, the heel lever in the open position engages the heel of the boot frictionally and is held against the boot heel in the closed position by the tension of the cable and by introducing the lower extremity or a flange of the heel lever into a groove or indentation of the boot heel, thereby holding the upper portion of the heel lever securely against the boot heel in the closed position with the camming surface presented to the anterior surface of the heel block. A continuation of the same downward movement of the heel of the boot forces the camming surface of the heel lever against the anterior surface of the heel block, whereby the boot is reversibly attached to the sports equipment by the frictional forces between the lever and the heel of the boot, and between the heel lever and the heel block.

SUMMARY

From the foregoing description the novelty, utility, and means of producing and practicing my invention will be readily apprehended. However, the foregoing description merely represents the best mode known to me as of the present date. The embodiments herein disclosed are not meant to be exclusive of other ways of practicing my invention, and it will be obvious to those of average skill in the field that other means of practicing the invention lie within the scope of this disclosure and the claims, below. Consequently, the metes and bounds of my invention are not limited to the embodiments disclosed above but encompass any and all embodiments within the scope of the following claims.

I claim:

1. A step-in binding for securing a boot to sports equipment wherein the boot has a boot toe and a boot heel, said step-in binding comprising:

a. a toe-portion (210) attached to the sports equipment, wherein said toe-portion reversibly secures the boot toe to the sports equipment;

b. a heel lever (60) comprising a camming surface (100) and a heel engagement mechanism comprising a flange (130) that engages a groove or indentation (120) in the boot heel;

c. a heel block (40) attached to the sports equipment, wherein said heel block comprises an anterior surface (110);

d. wherein the boot heel is reversibly secured to the sports equipment by the frictional engagement between 1) the boot heel and said heel lever and 2) said heel lever camming surface and said heel block anterior surface;

e. a locking mechanism that reversibly locks said heel lever in an open position, said locking mechanism comprising one of: a magnetic assembly, a ball and socket connection (170, 180) and a point (140) and matching catch (150);

f. a pivot point (95) of said heel lever, wherein said heel lever is rotatable about said pivot point and wherein as a result of the rotation of said heel lever about said pivot point said heel lever is adapted to assume 1) a closed configuration or position in which the heel lever frictionally engages the boot heel, and, alternatively, 2) said open configuration or position in which the heel lever is disengaged from the boot heel;

g. a cable (50), wherein:

i. said cable is connected to said toe-portion;

ii. said cable is adapted to reversibly encircle the boot heel when the boot toe is received by said toe-portion thereby reversibly securing the boot toe to said toe-portion;

iii. said heel lever is attached to said cable; and, iv. said pivot point of said heel lever is formed by the attachment of said heel lever to said cable, whereby said lever assumes the open configuration or position and closed configuration or position by rotation about said pivot point.

* * * * *